15F-20P SF
10/15/85 XP 4,547,253

United States Patent [19]

Heaney et al.

[11] Patent Number: 4,547,253

[45] Date of Patent: Oct. 15, 1985

[54] DEVICE FOR MAKING GROOVES IN CIGARETTE FILTERS

[75] Inventors: Richard Heaney, Campbell; Steven P. Reed, Felton, both of Calif.

[73] Assignee: Brown & Williamson Tobacco Corporation, Louisville, Ky.

[21] Appl. No.: 631,962

[22] Filed: Jul. 18, 1984

[51] Int. Cl.[4] ..... A24C 5/50

[52] U.S. Cl. ..... 156/553; 156/209; 156/441; 156/500; 264/293; 425/385; 425/392; 493/42

[58] Field of Search ..... 156/209, 219, 220, 441, 156/500, 553; 493/42, 43; 264/284, 293; 425/383, 385, 392; 101/4–6, 8, 11, 22–25, 36–37

[56] References Cited

U.S. PATENT DOCUMENTS

| | | | |
|---|---|---|---|
| Re. 29,674 | 6/1978 | Labbe | 264/284 X |
| 3,012,274 | 12/1961 | Levy | 425/392 |
| 3,826,177 | 7/1974 | Berger et al. | 493/43 |
| 4,075,936 | 2/1978 | Berger et al. | 493/43 |

*Primary Examiner*—David Simmons
*Attorney, Agent, or Firm*—Charles G. Lamb

[57] ABSTRACT

A device for concurrently forming a plurality of generally longitudinally extending grooves in a filter rod includes at least one pair of groove forming rollers located in a common plane, with their axes of rotation generally parallel and with their peripheries spaced apart. A plurality of elongated, generally arcuately shaped groove forming projections are spaced apart from each other around the circumference of each of the rollers. Each groove forming projections of one roller is in opposed facing, coextensive, aligned relationship with a different one of the groove forming projections of the other roller across the space separating the peripheries of the rollers. As a filter rod to be grooved passes through the space between the peripheries of the rollers, the rollers are rotated and the groove forming projections embed into the peripheral surface of the filter rod thusly forming grooves into the peripheral filter rod surface.

4 Claims, 6 Drawing Figures

DEVICE FOR MAKING GROOVES IN CIGARETTE FILTERS

BACKGROUND OF THE INVENTION

1. Field of the Invention

The present invention relates to the manufacture of filters for cigarettes and more particularly to the making of grooves in cigarette filters. In addition, the present invention relates to the making of apertures in the grooves at preselected locations.

2. Description of the Prior Art

Cigarettes are often provided with filter devices at one end to remove materials from the smoke stream coming from the tobacco column during smoking. These filters, which are attached to the tobacco column, come in many different sizes, shapes and forms. Some filters which are presently on the market include grooves. In some filter constructions the grooves faciliatate the by-passing of smoke around the filter. In other filter constructions the grooves provide a channel for mixing ventilating air and by-passed smoke. In still other constructions the grooves provide a path for only ventilating air to pass therealong without mixing with smoke.

In the manufacture of grooved cigarette filters, many suggestions have been made for making the grooves in the filter rod. U.S. Pat. No. 3,804,695 shows the use of a pair of parallel rollers in pressure engagement defining a nip therebetween wherein one of the rollers is provided with a circumferential or a helical grooved surface so that, as a filter rod passes therethrough, permanent depressions are made along the longitudinal dimensions of the filter rod. U.S. Pat. No. 4,075,936 shows a die having cam manipulated radially reciprocating pins that periodically move into and out of the longitudinal path of a filter rod as the filter rod tow moves past. When the pins extend into the path of the tow they impress grooves in the filter rod. U.S. Pat. No. 4,149,546 shows an apparatus for making grooves in a cigarette filter wherein a filter rod is moved in an arcuate path transverse to a heated forming means, the filter rod being supported and conveyed for relative movement at the periphery of a drum-shaped inner rotor and the forming means compresses a heated arcuate outer strator element or elements projecting inwardly toward the rotor. U.S. Pat. No. 4,324,540 teaches an apparatus for making grooves in filter which comprises a plurality of fixed position groove forming blades and a filter plug conveying device located next to the groove forming blades. Cigarette filters to be grooved are moved along the path between the conveyor device and blades, rolling past the blades whereupon grooves are formed in the filters by the blades.

SUMMARY OF THE INVENTION

The present invention provides a device for making grooves in cigarette filter rods. The present invention further provides a device for concurrently forming a plurality of elongated grooves in the peripheral surface of a filter rod.

More particularly, the present invention provides a device for making elongated grooves in the peripheral surface of filter rods comprising at least one pair of groove forming rollers, the rollers being in substantially a common plane, and the peripheries of the rollers being spaced apart by a predetermined distance, a plurality of elongated, generally arcuately shaped groove forming projections mutually spaced apart around the circumference of each roller and generally radially extending from the periphery of each roller, each groove forming projection of one roller being in opposed facing, coextensive, aligned relationship with a different one of the groove forming projections of the other roller across the space separating the peripheries of the rollers.

BRIEF DESCRIPTION OF THE DRAWINGS

A more complete understanding of the present invention will be obtained upon reference to the following description in conjunction with the accompanying drawings in which like numerals refer to like parts and wherein.

DESCRIPTION OF THE PREFERRED EMBODIMENTS

Figure 1:
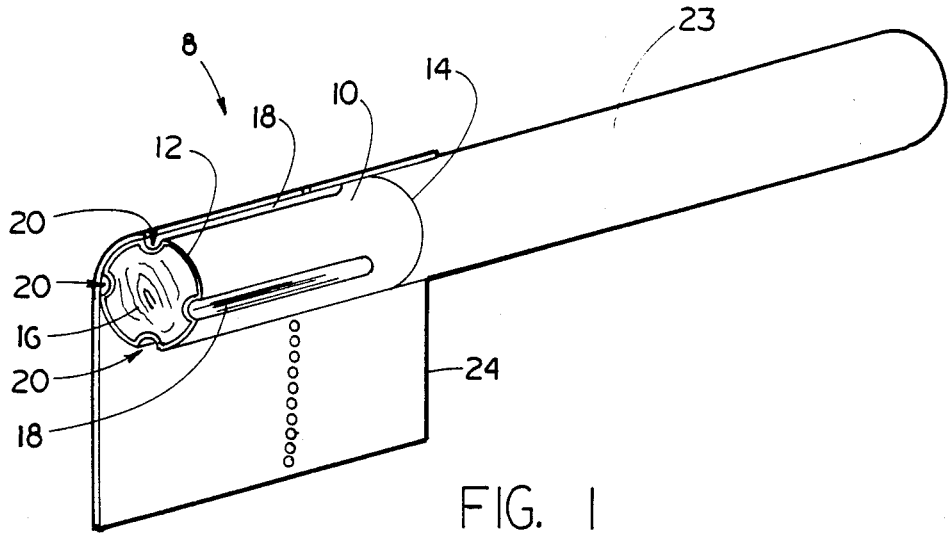
FIG. 1 is a perspective view of a cigarette having a filter rod attached thereto being capable of manufacturing the filter rod of the present invention.

Novel cigarette filter 8 of the type illustrated in FIG. 1 comprise a generally cylindrically shaped filter rod 10 fabricated of an air and smoke permeable material and a circumscribing wrapper 12 fabricated of an air and smoke impermeable material. The wrapper 12 extends longitudinally of the filter rod 10 from one end 14 of the filter rod to the other end 16 thereof so that the filter rod ends 14 and 16 are in mutual flowthrough relationship. The filter 8 includes a plurality of grooves 18 formed in the wrapper 12 and embedded into the filter rod 10. Each of the grooves 18 is open, as designated by the number 20, at the mouth end 16 of the filter rod 10 and extends therefrom in a generally longitudinal direction of the filter rod 10 for a distance less than the length of the filter rod 10. The grooves 18 are illustrated as being four in number, and equally spaced from each other about the circumference of the filter rod 10. The filter rod 10 is attached to a tobacco column 23 by means of an air permeable tipping material 24 which circumscribes the filter rod and overlaps a portion of the tobacco column in a manner known in the art to form a filtered cigarette. The tipping material 24 is formed with perforations to allow ambient air to flow into the grooves 18. In FIG. 1 the tipping material shown in a partially unwrapped position to more clearly show details of the wrapped filter rod.

Figure 2:
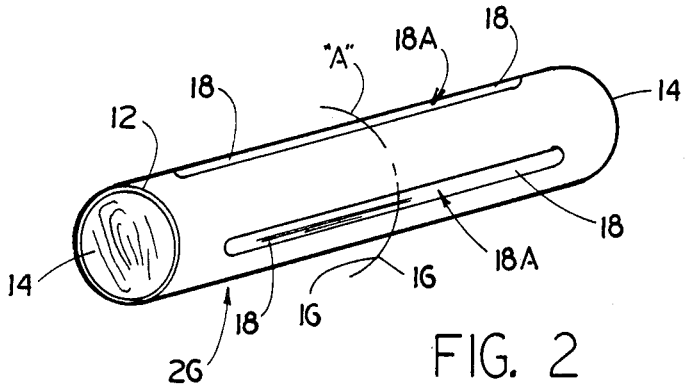
FIG. 2 is a perspective view of a filter tow from which the representative filter rod of FIG. 1 is made and which the apparatus of the present invention is capable of manufacturing.

Now with reference to FIG. 2, as a manufacturing expedient, individual filter rods 10 are manufactured from a filter tow 26. The filter tow 26 is of a generally cylindrical shape and is as long as a preselected number of filter rods 10. As illustrated, the filter tow 26 is twice as long as a filter rod 10. The filter tow 26 is formed with longitudinally extending grooves 18A, each of which is twice as long as a groove 18 in the filter rod 10. The filter rod 26 is severed, generally transversely to the longitudinal centerline of the filter tow 26, at intervals corresponding to the desired filter rod 10 length, into individual filter rods 10. As illustrated, the filter tow 26 is severed at a location (denoted by the dashed line "A") at the transverse centerline of the double length grooves 18A. Thus, in the illustrations of FIG. 2, two individual filter rods 10 are produced by severing the filter tow 26 at the dashed line A.

Figure 4:
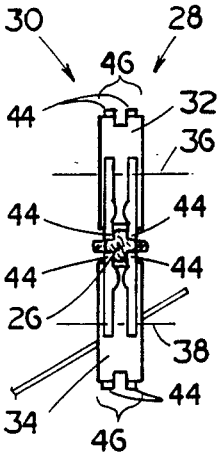
FIG. 4 is an end view of the device of FIG. 3 as viewed in the direction of arrows 4—4 in FIG. 3.
Figure 3:
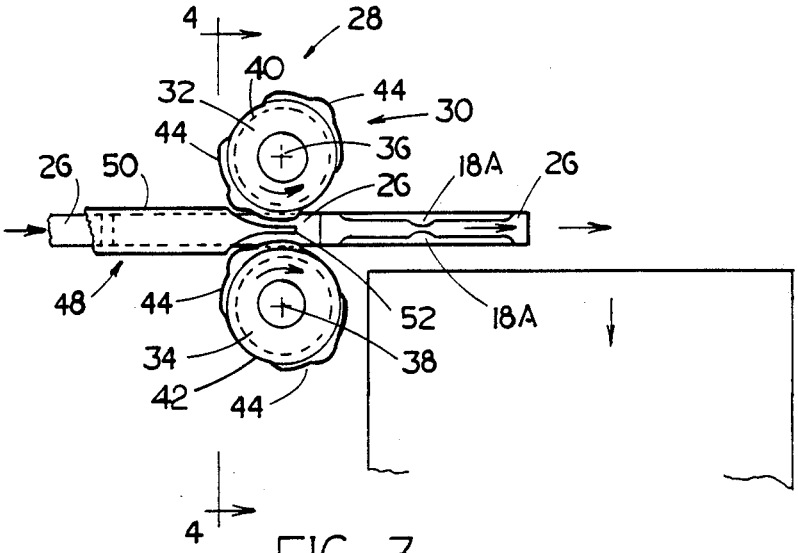
FIG. 3 is a side view of one advantageous embodiment of the present invention.

FIGS. 3 and 4 show a device, generally denoted as the numeral 28, for making grooves 18 in the filter rod 10 of FIG. 1. For the reasons mentioned above, and as a further manufacturing expedient, the device 28 is adapted to form a plurality double length grooves 18A in a filter rod tows 26 at one time in order to obtain a high rate of production. Therefore, the following discussion will speak to forming double length grooves 18A in the filter tows 26, but it should be clearly understood that the apparatus 28 could be just as readily be used to form grooves 18 in individual filter rods 10 essentially without modification.

Referring to FIGS. 3 and 4, the device 28 comprises a pair 30 of groove forming rollers 32 and 34 oriented with their rotational axes 36 and 38, respectively, being generally parallel. As shown, the rotational axes 36 and 38 are generally horizontal. The rollers 32 and 34 are substantially in a common plane which is illustrated as being a vertical plane. The peripheries 40 and 42 of the rollers 32 and 34, respectively, are spaced apart by a predetermined distance approximately equal to the diameter of the filter tow 26 to be grooved. The space between the roller peripheries 40 and 42 defines the path of travel of a filter tow 26 to be grooved between the rollers 32 and 34.

With continued reference to FIGS. 3 and 4, each roller 32 and 34 includes a plurality of elongated, generally arcuately shaped groove forming projections 44. The groove forming projections 44 are equally spaced apart around the circumference of each roller 32 and 34 and generally radially extend from the peripheries 40 and 42 of the rollers 32 and 34, respectively, by a distance generally equal to the depth of the groove 18A to be formed thereby. As the rollers 32 and 34 rotate, each groove forming projection 44 of one roller, for example, roller 32 moves into and out of facing, coextensive, aligned relationship with different one of the groove forming projections 44 of the other roller 34 across the space separating the peripheries 40 and 42 of the rollers 32 and 34. As can be best seen in FIG. 4, the groove forming projections 44 are arranged in groups 46. Each group 46 of groove forming projections 44 includes at least two spaced apart, generally parallel, side by side groove forming projections 44. The distance between groove forming projections 44 of each group 46 is less than the diameter of the filter rod tow 26 to be grooved. As the rollers 32 and 34 rotate, each group 46 of groove forming projections 44 of roller 32 comes into opposed facing, coextensive aligned relationship with a different group 46 of groove forming projections 44 of roller 34.

With reference to FIG. 3, entrance guide means, generally denoted by the number 48, is located upstream of the pair 30 of rollers 32 and 34 to guide the filter rod tow 26 to be grooved into the space between the rollers 32 and 34. The entrance guide means 48 is illustrated as a tube 50 located with its longitudinal axis generally perpendicular to the rotational axes 36 and 38 of the rollers 32 and 34 and in alignment with the space between the rollers 32 and 34. The inside diameter of the entrance guide tube 50 is sized to coaxially receive the filter rod tow 26 to be grooved with a slide fit so that the filter rod tow 26 can easily move concentrically through the guide tube 50. As shown, the exit end 52 of the guide tube 50 extends into the space between the rollers 32 and 34 and the portions of the wall of the tube 50 adjacent to the rollers 32 and 34 is cut-away to provide a clearance for the groove forming projections 44.

In operation, the filter rod tow 26 to be grooved is pushed concentrically through the entrance guide tube 50 into the space between the rollers 32 and 34 by pusher means, not shown. The pusher means may include, for example, a reciprocating finger conveyor, or wheel. The rollers 32 and 34 rotate about their respective axes of rotation 36 and 38 at a coordinated angular velocity with each other, and the peripheries 40 and 42 frictionally engage the filter rod tow 26. Once engaged by the rollers 32 and 34, the filter rod tow 26 moves through the space between the rollers 32 and 34, and the groove forming projections 44 are embedded into the peripheral surface of the filter rod tow 26 forming grooves 18A therein.

It is foreseeable that the rollers 32 and 34 be heated by, for example, electrical resistance heating means if the material of the filter rod tow 26 has such a high modulus of elasticity that it will not take a permanent set when the groove forming projections are implanted in the peripheral surface of the filter rod tow 26.

Figure 6:
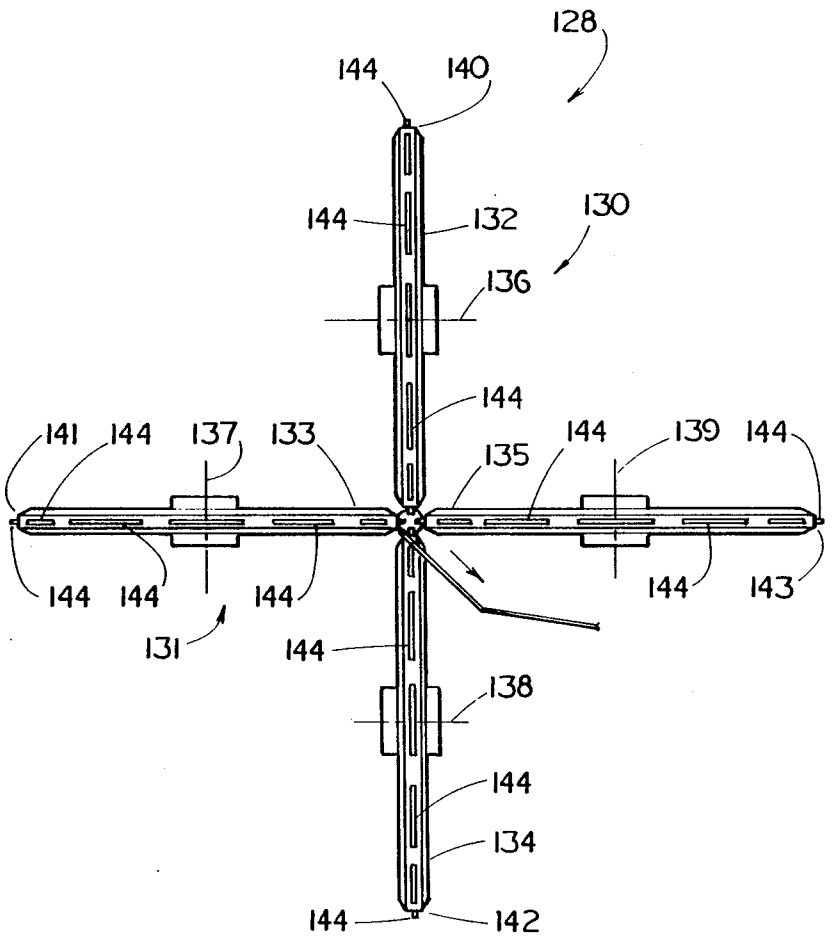
Figure 5:
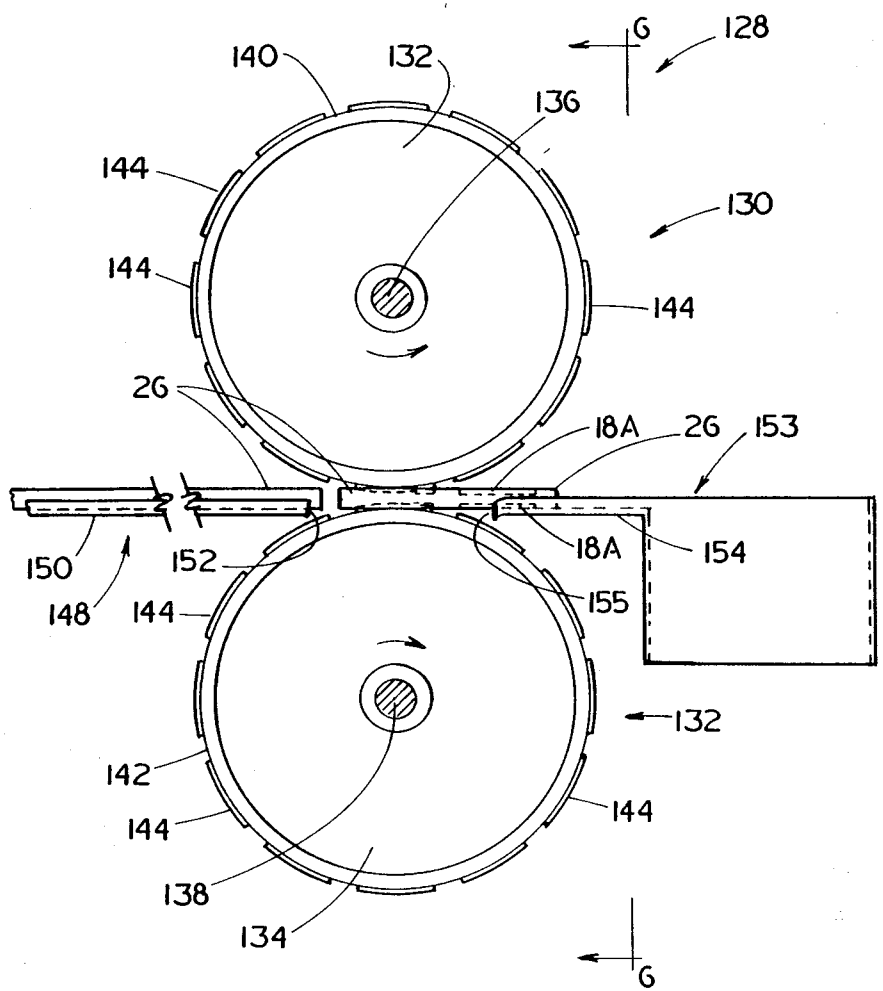
FIG. 5 is a side view of another advantageous embodiment of the present invention; and, FIG. 6 is an end view of the device of FIG. 5 as viewed in the direction of arrows 6—6 in FIG. 5.

Now with reference to FIGS. 5 and 6, there is shown another advantageous embodiment of the device of the present invention, generally denoted by the number 128. The device 128 is shown as comprising a first pair 130 of groove forming rollers 132 and 134, and a second pair 131 of groove forming rollers 133 and 135. As shown, the rollers 132 and 134 of the first pair 130 are oriented with their rotational axes 136 and 138, respectively, being generally mutually parallel and horizontally disposed so that the rollers 132 and 134 rotate in a vertical plane. In addition, the rollers 132 and 134 are in a substantially common plane which is illustrated as being a vertical plane. The peripheries 140 and 142 of the rollers 132 and 134, respectively, are spaced apart by a predetermined distance approximately equal to the diameter of the filter rod tow 26 to be grooved. The rollers 133 and 135 of the second pair 131 are oriented with their rotational axes 137 and 139, respectively, being generally mutually parallel and vertically disposed so that the rollers 133 and 135 revolve in a horizontal plane. In addition, the rollers 133 and 135 are in a substantially common plane which is illustrated as being a horizontal plane. The peripheries 141 and 143 of the rollers 133 and 135, respectively, are spaced apart by a predetermined distance approximately equal to the diameter of the filter rod tow 26 to be grooved. The space between the peripheries of the rollers 132, 134 and between the peripheries of the rollers 133, 135 define the path of travel of a filter rod tow 26 to be grooved between the rollers 132, 134 and 133, 135. As can be best seen in FIG. 6, the rollers 133 and 135 of the second pair 131 are equally spaced apart to either side of the common plane of the first roller pair 130 and are further located such that the common plane of the second roller pair 131 bisects the space between the rollers 132 and 134 of the first roller pair 130. As shown in FIG. 6, the space between the rollers 133 and 135 is coincident with the space between the rollers 132 and 134. However, it should be understood that the rollers 133 and 135 of the second roller pair 131 could be located either upstream or downstream, relative to the movement of the filter rod tow 26 to be grooved, from the rollers 132 and 134 of the first roller pair 130 with the space between the rollers 132 and 134 in alignment with the space between the rollers 133 and 135. In this event, the distance between the roller pairs 130 and 131 should be somewhat less than the length of a filter rod 26 so that the second pair 131 of rollers will engage the filter rod 26 before the first roller paid 130 releases the filter rod 26. The particular advantage of locating the roller pairs 130 and 131 with the space between their respective rollers being coincident is that this arrangement makes for a more compact grooving device 128 and the forces exerted by the rollers on the filter rod tow 26 are balanced around the filter rod tow.

With continued reference to FIGS. 5 and 6, each roller 132, 133, 134 and 135 is virtually identical and each includes a plurality of elongated, generally arcuately shaped groove forming projections 144. The groove forming projections 144 are equally spaced apart around the circumference of the rollers and generally radially extend from the peripheries 140, 141, 142 and 143 of the respective rollers 132, 133, 134 and 135 by a distance substantially equal to the depths of the grooves 18A to be formed in the filter tow 26. As the rollers 132 and 134 rotate, each groove forming projection 144 of roller 132 comes into opposed facing, coextensive, aligned relationship with a different one of the groove forming projections 144 of roller 134 across the space separating the peripheries 140 and 142 of the rollers 132 and 134. Similarly, as the rollers 133 and 135 rotate, each groove forming projection 144 of roller 133 comes into opposed facing, coextensive, aligned relationship with a different one of the groove forming projections 144 of the roller 135 across the space separating the peripheries 141 and 143 of the rollers 133 and 135. In the embodiment shown in FIGS. 5 and 6, it should also be understood that the groove forming projections 144 of the rollers 132 and 134 move into and out of the above discussed mutually opposed facing relationship simultaneously with the movement of the groove forming projections 144 of the rollers 133 and 135 into and out of the above discussed mutually opposed facing relationship.

With reference to FIG. 5, entrance guide means, generally denoted by the number 148, is located upstream of the roller pairs 130 and 131 to guide a filter rod tow 26 to be grooved into the space between the rollers 132, 134, 133 and 135. The entrance guide means 148 is illustrated as a channel member 150 located with its longitudinal axis generally perpendicular to the rotational axes 136, 138, and 137, 139 of the first and second roller pairs 130 and 131, respectively, and in alignment with the space between the rollers 132, 134, 133 and 135. The channel member 150 is sized to coaxially receive the filter rod tow 26 to be grooved with a slide fit so that the filter rod tow 26 can move concentrically through the channel member 150. As shown, the exit end 152 of the entrance guide channel 150 extends somewhat into the space between the rollers but terminates short of the location whereat the groove forming projections 144 come into mutually facing opposed relationship. Exit guide means, generally denoted by the number 153, is located downstream of the roller pairs 130 and 131 to guide a grooved filter rod tow 26 away from the space between the rollers 132, 134, 133 and 135. The exit guide means 153 is illustrated as a channel member 154 located with its longitudinal axis in line with the longitudinal axis of the entrance guide channel 150. The exit channel member 154 is sized to coaxially receive the grooved filter rod tow 26 with a slide fit so that the grooved rod tow 26 can move concentrically through the exit channel member 154. The entrance end 155 extends somewhat into the space between the rollers but short of the location whereat the groove forming projections 144 come into mutually facing opposed relationship. The exit end 152 of entrance channel member 150 and entrance end 155 of exit guide channel 154 are spaced apart by the appropriate distance to support a filter rod tow 26 therebetween while the filter rod tow is being grooved by the groove forming projections 144 in the space between the entrance channel exit end 152 and exit channel entrance end 155.

In operation, the filter rod tow 26 to be grooved is pushed concentrically along the entrance guide channel 150 into the space between the rollers 132, 134, 133 and 135 by pusher means 156. The rollers 132 and 134 rotate about their respective axes 136 and 138, and the rollers 133 and 135 rotate about their respective axes 137 and 139 at a coordinated angular velocity with each other. Once engaged by the rollers 132, 134, 133 and 135, the filter rod tow 26 moves through the space between the rollers 132, 134, 133 and 135 and the groove forming projections 144 are embedded into the peripheral surface of the filter rod tow 26 forming embedded grooves 18 therein.

It is foreseeable that the rollers 132, 134, 133 and 135 be heated by, for example, electrical resistance heating means if the material of the filter rod tow 26 has such a high modulus of elasticity that it will not take a permanent set when the groove forming projections are implanted in the peripheral surface of the filter rod tow 26.

It should be understood that the apparatus 28,128 can be used to form grooves 18 in filter rods 10 essentially without modification and, therefore, the term filter rod is used in a generic sense in the appended claims to mean either individual filter rods 10 or filter tow 26 from which individual filter rods 10 are out after the apparatus of the present invention has formed grooves therein.

The foregoing detailed description is given primarily for clearness of understanding and no unnecessary limitations are to be understood therefrom for modifications will become obvious to those skilled in the art upon reading this disclosure and may be made without departing from the spirit of the invention or scope of the appended claims.

What is claimed is:

1. A device for making four elongated grooves in the peripheral surface of filter rods equally spaced apart from each other about the circumference of the filter rod comprising:

one pair of groove forming rollers, the rotational axes of the rollers being generally parallel, the rollers being substantially in a common plane, and the periphery of the rollers being spaced apart by a predetermined distance greater than the diameter of a filter rod to be grooved;

a plurality of elongated, generally arcuately shaped groove forming projections mutually spaced apart around the circumference of each roller and generally radially extending from the periphery of each roller, each groove forming projection of one roller moves into and out of opposed facing, coextensive, aligned relationship with a different one of the groove forming projections of the other roller across the space separating the peripheries of the rollers as the rollers rotate; the groove forming projections of each roller are arranged in groups of two spaced apart, generally side by side groove forming projections, and the two grooves forming projections of each group of grooves are spaced apart by a distance substantially equal to the distance between opposed facing, coextensive, aligned groove forming projections of the two rollers across the space separating the rollers.

2. The groove making device of claim 1, wherein the rollers rotate at a coordinated angular velocity with each other.

3. The groove making device of claim 1, wherein the rollers are heated.

4. The groove making device of claim 1, wherein all of the rollers are identically configured and sized.

* * * * *